US009220340B2

(12) United States Patent
Kuo

(10) Patent No.: US 9,220,340 B2
(45) Date of Patent: Dec. 29, 2015

(54) BATHROOM SHELF ASSEMBLY AND BATHROOM SHELF HAVING THE SAME

(71) Applicant: Anthony Kuo, Taichung (TW)

(72) Inventor: Anthony Kuo, Taichung (TW)

( * ) Notice: Subject to any disclaimer, the term of this patent is extended or adjusted under 35 U.S.C. 154(b) by 122 days.

(21) Appl. No.: 14/146,592

(22) Filed: Jan. 2, 2014

(65) Prior Publication Data

US 2015/0182019 A1 Jul. 2, 2015

(51) Int. Cl.
*A47K 10/10* (2006.01)
*A47B 47/00* (2006.01)
*A47B 96/02* (2006.01)

(52) U.S. Cl.
CPC ..... *A47B 47/0058* (2013.01); *A47K 10/10* (2013.01); *A47B 96/027* (2013.01); *A47K 2201/02* (2013.01)

(58) Field of Classification Search
CPC .... A47K 10/10; A47K 10/04; A47K 2201/02
See application file for complete search history.

(56) References Cited

U.S. PATENT DOCUMENTS

| | | | | |
|---|---|---|---|---|
| 2,473,771 | A * | 6/1949 | Slater | 211/123 |
| 4,514,107 | A * | 4/1985 | Moreno | 403/230 |
| 4,643,607 | A * | 2/1987 | Caudill et al. | 403/194 |
| 5,026,013 | A * | 6/1991 | Robbins | 248/221.12 |
| 5,186,427 | A * | 2/1993 | Semchuck | 248/251 |
| 5,803,645 | A * | 9/1998 | Moser et al. | 403/243 |
| 6,726,036 | B2 * | 4/2004 | Koellner | 211/104 |
| 7,111,336 | B1 * | 9/2006 | Lai | 4/576.1 |
| 7,490,803 | B1 * | 2/2009 | Graves | 248/251 |
| 7,874,025 | B2 * | 1/2011 | Bowden et al. | 4/576.1 |
| 7,926,772 | B2 * | 4/2011 | Lowe et al. | 248/222.14 |
| 7,934,274 | B2 * | 5/2011 | Forrest et al. | 4/576.1 |
| 8,646,626 | B2 * | 2/2014 | Hsu et al. | 211/119.009 |
| 8,671,545 | B1 * | 3/2014 | Zimmerman | 29/525.01 |
| 2007/0175842 | A1 * | 8/2007 | Shieh | 211/88.04 |
| 2009/0188879 | A1 * | 7/2009 | Shieh | 211/88.04 |
| 2009/0223912 | A1 * | 9/2009 | Chen | 211/48 |

FOREIGN PATENT DOCUMENTS

| | | | | |
|---|---|---|---|---|
| EP | 1656868 | A2 * | 5/2006 | |
| EP | 1695647 | A2 * | 8/2006 | A47B 95/02 |

* cited by examiner

*Primary Examiner* — Joshua Rodden
*Assistant Examiner* — Kimberley S Wright
(74) *Attorney, Agent, or Firm* — Muncy, Geissler, Olds & Lowe, P.C.

(57) ABSTRACT

A bathroom shelf assembly and a bathroom shelf having the same are provided. The bathroom shelf assembly includes a tubular member, at least one inserting member, a first rod member and at least one first connecting bar. The tubular member has a tubular wall and an interior channel extending between two ends thereof, and the tubular wall is formed with at least one first through hole. The inserting member is disposed in the tubular channel and has an axial through bore parallel to the interior channel. The first rod member is disposed through the axial through bore in the interior channel. At least one end of each first connecting bar is formed with a first radial slot, and each first connecting bar is disposed through corresponding through hole and spraddled onto the first rod member via the first radial slot.

3 Claims, 3 Drawing Sheets

BATHROOM SHELF ASSEMBLY AND BATHROOM SHELF HAVING THE SAME

BACKGROUND OF THE INVENTION

1. Field of the Invention

The present invention relates a bathroom device, more particularly, to a bathroom shelf assembly and a bathroom shelf having the same.

2. Description of the Prior Art

Usually, bathroom shelves are mounted in bathrooms for people to hang or place towels, clothes and other bathing products. In view of anti-humidity, stability and structural strength, most of the bathroom shelves are made of metal. Among the conventional bathroom shelves, most common structure is that two metal connecting bases are firstly fixedly disposed on the wall of a bathroom, and then a placing shelf with one or a plurality of rod members or hanging members is fixedly attached to the two metal connecting bases. However, the two metal connecting bases are usually made by chiseling a solid metal body or processing in other ways to form mounting holes provided for being inserted by rod members or hanging members; therefore, it is material-wasting, high-cost, heavy and difficult to process.

More importantly, regarding the assembling of conventional bathroom shelves, the rod members or the hanging members are usually inserted into the mounting holes of the metal connecting base, and then a force is imposed to rivet the rod members or the hanging members with the metal connecting base; or the rod members or the hanging members are welded with the metal connecting base, wherein riveting can cause problems like tilt, bending or deformation, the bearing surface of a plurality of the rod members or the hanging members will be uneven, and overall structural strength will be affected. In addition, when the rod members or the hanging members are riveted or welded with the metal connecting base, they become integrally connected; therefore, it is difficult to dissemble and to cooperate with other structures. What's more, when a component is damaged, the whole bathroom shelf needs to be replaced; thus, it is inconvenient and costly to maintain or repair the bathroom shelf.

The conventional bathroom shelf structure disclosed in TWM267987, wherein a plurality of horizontal rods are disposed between two hollow straight tubes, two long rods are respectively disposed through through holes of the horizontal rods in the two hollow straight tubes to form a hanging shelf structure. However, because the two long rods need to be respectively disposed through the through holes of the horizontal rods when being assembled, factors like that the long rods are not pre-positioned or that errors occur during the manufacturing process of the through holes of the horizontal rods; therefore, the long rods will be difficult to be assembled and prone to tilt. In addition, when one of the hollow straight tubes or the horizontal rods is damaged, the long rods needs to be removed from the hollow straight tubes or the horizontal rods first so as to conduct replacement, so it is inconvenient to maintain or repair.

The present invention is, therefore, arisen to obviate or at least mitigate the above-mentioned disadvantages.

SUMMARY OF THE INVENTION

The main object of the present invention is to provide a bathroom shelf assembly and a bathroom shelf having the same, which can prevent problems like tilt, bending or deformation from happening and have the advantages, for example, it is convenient to maintain or repair, low-cost, easy to assemble or disassemble and easy to cooperate with other structures.

To achieve the above and other objects, the present invention provides a bathroom shelf assembly, including a tubular member, at least one inserting member, a first rod member and at least one first connecting bar. The tubular member has a tubular wall and an interior channel extending between two relative ends of the tubular member, and the tubular wall is formed with at least one first through hole. The at least one inserting member is disposed in the interior of the tubular member and has an axial through hole parallel to the interior channel. The first rod member is disposed through the axial through hole in the interior channel. At least one end of each first connecting bar is formed with a first radial slot, and each first connecting bar is disposed through corresponding first through hole and spraddled onto the first rod member via the first radial slot.

To achieve the above and other objects, the present invention further provides a bathroom shelf, including the above-mentioned two tubular members, two inserting members, two first rod members and at least one first connecting bar; and further including two mounting assemblies, and each of the two mounting assemblies is disposed at one end of corresponding tubular member for being fixedly attached to a base, wherein the two tubular members are arranged in parallel, every two of the first through holes of one of the two tubular members correspond to the first through holes of the other of the two tubular members respectively, each end of each first connecting bar is formed with the first radial slot, two ends of each first connecting bar are respectively disposed through corresponding first through holes of the tubular members and respectively spraddled onto the two first rod members via the two first radial slots.

To achieve the above and other objects, the present invention further provides a bathroom shelf, including two of the above-mentioned bathroom shelf assemblies, and further including two mounting assemblies. The two mounting assemblies are connected with the two bathroom shelf assemblies and respectively positioned at corresponding two ends of two tubular members for being fixedly attached to a base, wherein, the tubular wall of each tubular member is formed with a plurality of the first through holes, the two tubular members are substantially arranged in parallel, wherein, the first through holes of one of the two tubular members correspond to the first through holes of the other of the two tubular members respectively, two ends of each first connecting bar are respectively formed with the first radial slot, two ends of each first connecting bar are respectively disposed through corresponding through holes of the tubular member and spraddled onto the two first rod members via the two first radial slots.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
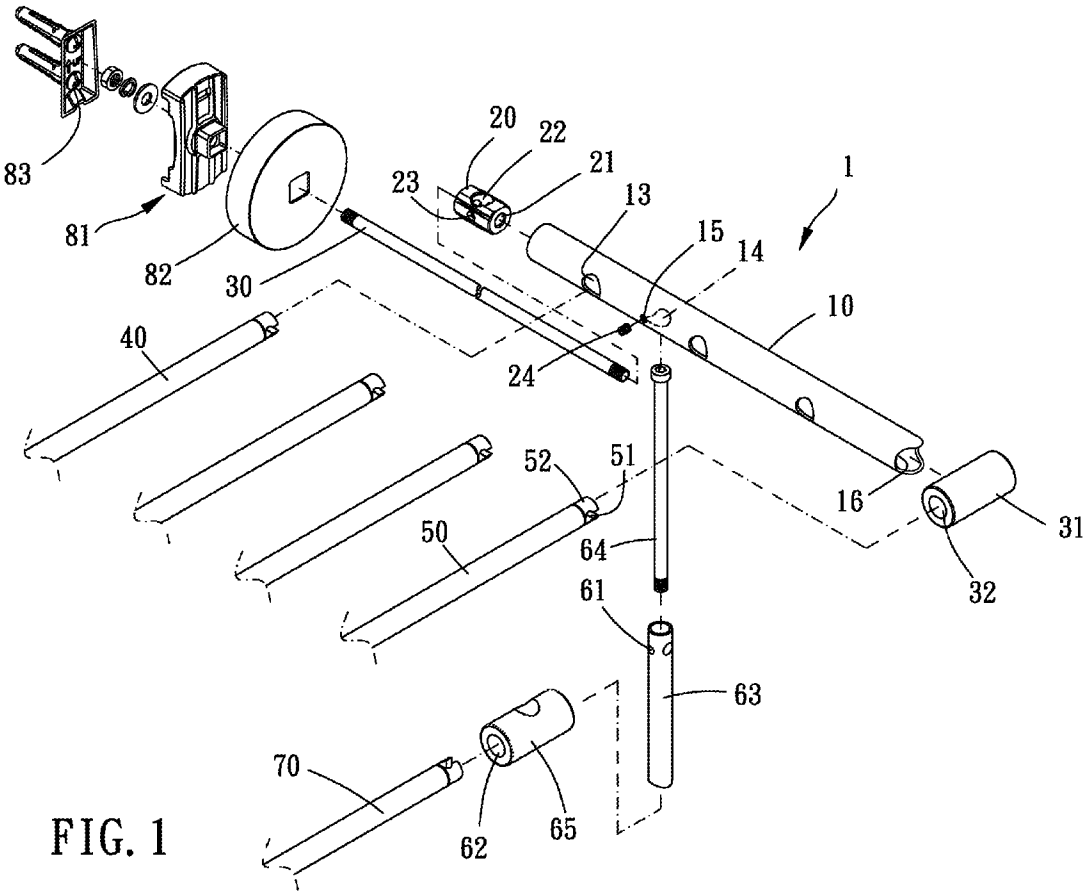
FIG. 1 is a breakdown drawing of a preferred embodiment of a bathroom shelf assembly of the present invention.
Figure 2:
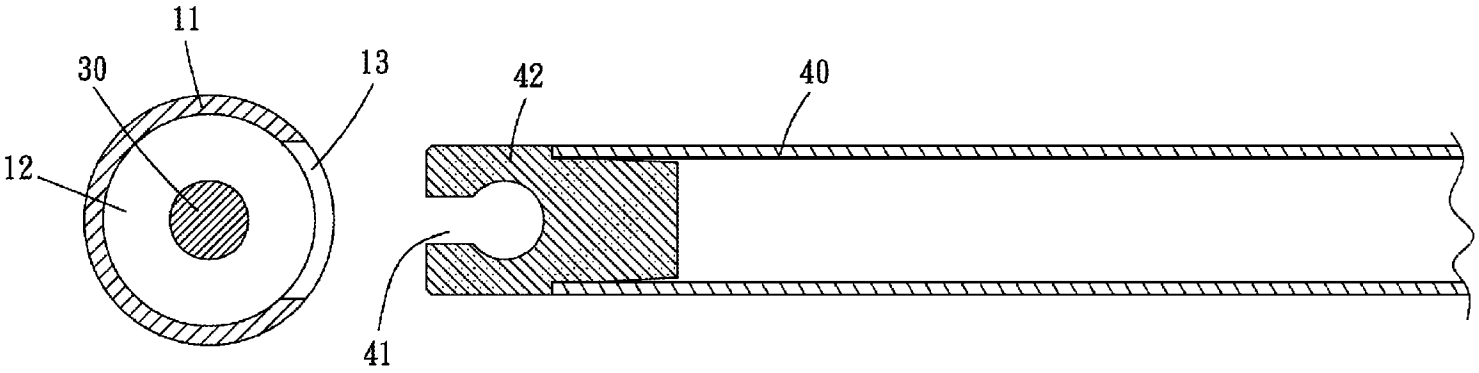
FIGS. 2 and 3 are sketches showing the preferred embodiment of the bathroom shelf assembly of the present invention.
Figure 3:
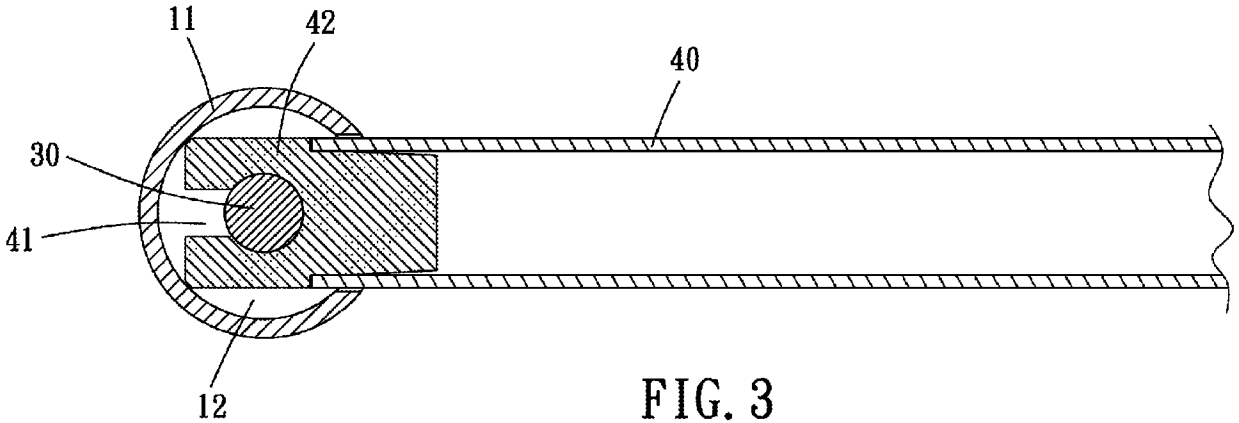
Figure 4:
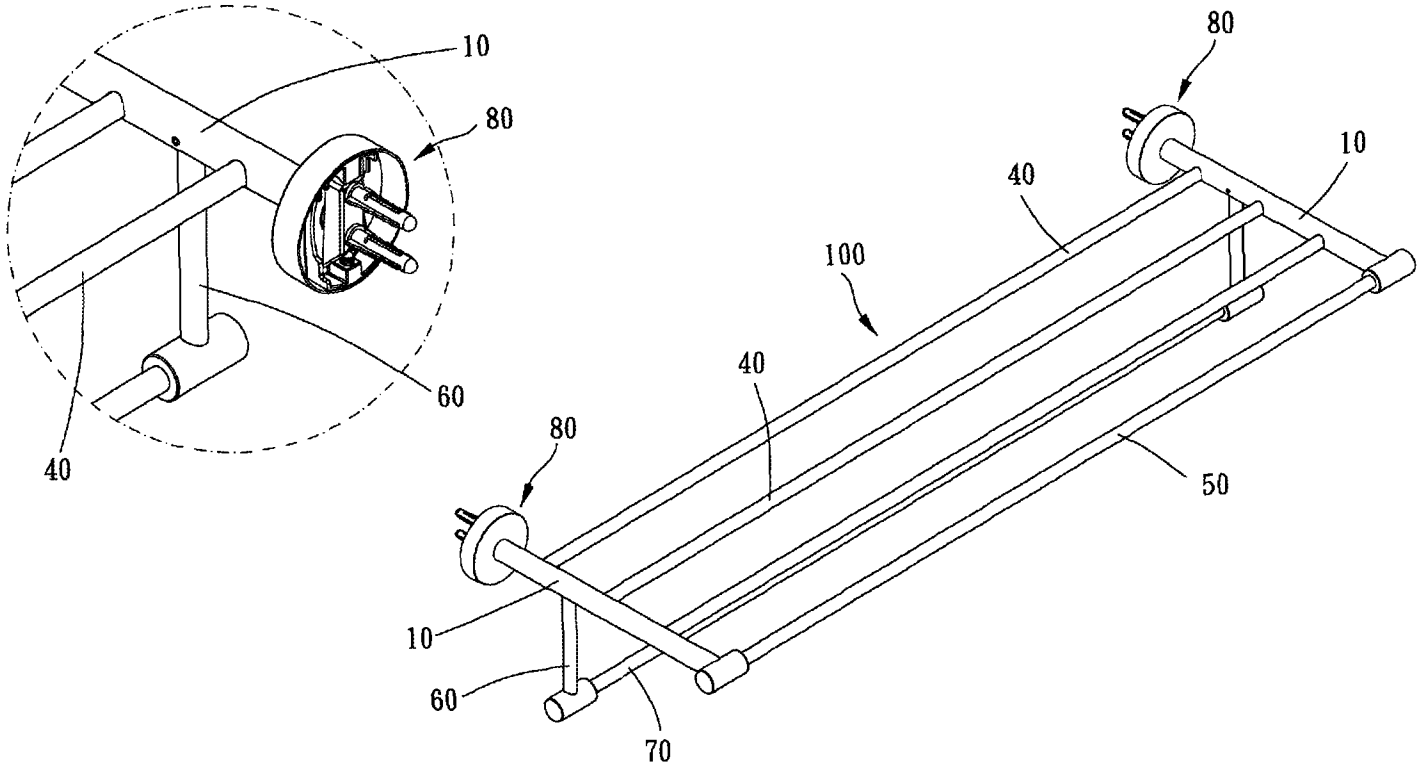
FIG. 4 is sketch of a preferred embodiment of a bathroom shelf of the present invention.

Please refer to FIGS. 1 to 4 for a first embodiment of the present invention. A bathroom shelf assembly 1 of the present invention includes a tubular member 10, at least one inserting member 20, a first rod member 30 and at least one connecting bar 40.

The tubular member 10 has a tubular wall 11 and an interior channel 12 extending between a first end and a second end corresponding to the first end of the tubular member 10, and the tubular wall 11 is formed with at least one first through hole 13. Specifically, the tubular wall 11 is formed with a plurality of the first through holes 13 arranged in intervals. The tubular wall 11 of the tubular member 10 is further formed with at least one second through hole 14, whose opening direction is opposite to an opening direction of the at least one first through hole 13, and a positioning through bore 15. The first end of the tubular member 10 is formed with a recessed opening 16, and in this embodiment, the opening direction of the second through hole 14 is substantially perpendicular to that of the first through hole 13.

The at least one inserting member 20 is disposed in the interior of the tubular member 10 and has an axial through hole 21 parallel to the interior channel 12. Each inserting member 20 includes a lateral hole 22 communicating with the axial through hole 21 and a positioning through hole 23. The later hole 22 corresponds to one of the second through hole 14, and a positioning member 24 is disposed in the positioning through bore 15 and partially extends to engage with corresponding inserting member 20. Specifically, the positioning member 24 is an adjustable screw member, and the screw member can be rotated into the positioning through hole 23 of the inserting member 20; thereby, the inserting member 20 can be selectively positioned in the tubular member 10.

The first rod member 30 is disposed through the axial through bore 21 in the interior channel 12, and the inserting member 20 can keep the first rod member 30 remaining at a position near the center of the interior channel 12 so as to facilitate assembling of the at least one first connecting bar 40. At least one end of each first connecting bar 40 is formed with a first radial slot 41, and each first connecting bar 40 is disposed through corresponding first through hole 13 and spraddled onto the first rod member 30 via the first radial slot 41. Specifically, a first end of the first rod member 30 is further formed with an enlarged head portion 31, and the outline of the enlarged head portion 31 corresponds to that of the recessed opening 16 so that the enlarged head portion 31 can be complementarily and tightly connected with the tubular member 10.

The corresponding first end and second end of the first rod member 30 are respectively formed with a threaded section, wherein, the enlarged head portion 31 and the threaded section of the first end of the first rod member 30 are detachably screwed, so it is convenient to assemble, disassemble and replace.

In this embodiment, the at least one end of each first connecting bar 40 is formed with a first plastic member 42, and the first radial slot 41 is formed on the first plastic member 42. The first plastic member 42 is a part which is detachably or integrally connected with the first connecting bar 40. An opening of the first radial slot 41 is preferably smaller than the radial size of the first rod member 30, wherein the first plastic member 42 is elastic, so the first plastic member can be expanded to be spraddled onto the first rod member 30 and then restrictedly clip on the first rod member 30. The enlarged head portion 31 is substantially a column perpendicular to the first rod member 30 and formed with a first connecting hole 32 provided for a second connecting bar 50 to assemble therein. The opening direction of the first connecting hole 32 is the same as that of the first through hole 13, so the second connecting bar 50 and the first connecting bar 40 are parallel to each other after being assembled.

At least one end of the second connecting bar 50 is formed with a second radial slot 51, and each second connecting bar 50 is disposed through the first connecting hole 32 and spraddled onto the first end of the first rod member 30 with the second radial slot 51. Specifically, the at least one end of each second connecting bar 50 is formed with a second plastic member 52, and the second radial slot 51 is formed on the second plastic member 52. More specifically, in this embodiment, the second connecting bar 50 has the same structure as the first connecting bar 40; however, their structures may be different in other embodiments, for example, the second connecting bar 50 may be provided without the second plastic member 52.

In this embodiment, the bathroom shelf assembly 1 can further include at least one second rod member 60, and an end of each second rod member 60 extends through corresponding second through hole 14 and into the interior channel 12. The first rod member 30 is disposed through the first end of the second rod member 60. Preferably, the second rod member 60 is formed with a positioning recession 61 (a through hole or a blind hole). The positioning member 24 is disposed through the positioning through hole 23 and into the positioning recession 61. The first rod member 30 is disposed through the first end of the second rod member 60, and the positioning member 24 is disposed through the positioning through hole 23 and into the positioning recession 61, so that double-positioning effect is achieved and that the second rod member 60 is stably assembled. Furthermore, a second end of the second rod member 60 is further formed with a second connecting hole 62 provided for a third connecting bar 70 to assemble therein (the structures of the third connecting bar 70 and the first connecting bar 40 can be the same or different). In this embodiment, the second rod member 60 includes an outer tube 63, an inner rod 64 and an enlarged head portion 65. An upper end of the inner rod 64 is formed with an inner hexagonal hole, and a lower end of the inner rod 64 is formed with a threaded section. The inner rod 64 is disposed in the outer tube 63; the upper end is abutted against the outer tube 63, and the threaded section is screwed to the enlarged head portion 65. Specifically, the second end of the second rod member 60 is formed with the enlarged head portion 65, and the enlarged head portion is substantially in column shape. The column-shaped enlarged head portion 65 formed with the second connecting hole 62 is parallel to the substantially column-shaped enlarged head portion 31, which means that the third connecting bar 70 is substantially parallel to the first connecting bar 40 and the second connecting bar 50.

It is noted that based on the spirit of the present invention, the structure of the bathroom shelf assembly 1 can be change or design in various ways. For example, the inserting member 20 can stretch across at least two of the first through holes 13, the inserting member 20 can be further formed at least two through holes corresponding to the first through holes 13 and the at least one first connecting bar 40 can be disposed through the first through hole 13 into the through hole of the inserting member 20 and spraddled onto the first rod member 30 via the first radial slot 41 so as to make the at least one first connecting bar 40 more stably and precisely connected; the first connecting bar 40, the second connecting bar 50 and the third connecting bar 70 can be hollow or solid so as to have lower weight and stronger structural strength; the opening directions of the first through hole 13 and the second through hole 14 are different so as to form different structures or spaces; the second connecting bar 50 can be screwed to the enlarged head portion 31 and the third connecting bar 70 can be screwed to the second end of the second rod member 60, so it is convenient to assemble, disassemble or replace.

The present invention further provides a bathroom shelf 100, including the above-mentioned two the tubular members 10, two the inserting members 20, two the first rod members 30 and at least one first connecting bar 40, and further including two mounting assemblies 80. The two mounting assemblies 80 are respectively disposed at two ends of corresponding tubular member 10, and the two mounting assemblies 80 are provided for being fixedly attached to a base (for example, bathroom walls or objects which can be stably connected with, not shown). In this embodiment, the mounting assemblies 80 including a mounting base 81 and a covering board 82. The mounting base 81 is fixedly attached to the base through two screw members 83 screwed from inside to outside, and the threaded section of the second end of the first rod member 30 is disposed through the covering board 82 and screwed to the mounting base 81; thereby, the bathroom shelf assembly 1 is stably disposed. Furthermore, the covering board 82 covers the mounting base 81 to protect the mounting base 81 and make the appearance aesthetic. After the bathroom shelf assembly 1 is completely assembled, the two tubular members 10 are substantially arranged in parallel, every two of the first through holes 13 of one of the two tubular members 10 correspond to the first through holes 13 of the other of the two tubular members 10 respectively, two ends of each first connecting bar 40 are respectively formed with the first radial slot 41, two ends of each first connecting bar 40 are respectively disposed through corresponding first through holes 13 of the tubular members 10 and respectively spraddled onto part of the two first rod members 30 via the two first radial slots 41.

In this embodiment, the bathroom shelf 100 of the present invention includes the two above-mentioned bathroom shelf assemblies 1, and further includes the two above-mentioned mounting assemblies 80. The two mounting assemblies 80 are connected with the two bathroom shelf assemblies 1 and respectively disposed at two ends of corresponding tubular members 10 (each of the mounting assemblies 80 can be design to connect with the tubular member 10 or the first rod member 30), and the two mounting assemblies 80 are provided for being fixedly attached to a base, wherein, a tubular wall 11 of each tubular member 10 is formed with a plurality of the first through holes 13, the two tubular members 10 are arranged in parallel, wherein, the first through holes 13 of one of the two tubular members 10 correspond to the first through holes 13 of the other of the two tubular members 10 respectively, two ends of each first connecting bar 40 are respectively formed with the first radial slot 41, two ends of each first connecting bar 40 are respectively disposed through corresponding first through holes 13 of the tubular member 10 and spraddled onto the two first rod members 30 via the two first slots 41.

Understandably, the bathroom shelf of the present invention, for example, can have only one of the first connecting bar 40, or have a plurality of the first connecting bars 40, or have one of the first connecting bars 40 and one of the second connecting bars 50, or have one of the first connecting bars 40, one of the second connecting bars 50 and one of the third connecting bars 70, or have a plurality of the first connecting bars 40, one of the second connecting bars 50 and one of the third connecting bars 70.

Given the above, the bathroom shelf assembly and the bathroom shelf having the same of the present invention can be simply assembled. The tubular member, the at least one inserting member, the first rod member and the at least one first connecting bar can be stably connected through ways of engaging and position-limiting. In conventional structures, the connecting bars are riveted into the inserting holes of two relative bases, so the at least one first connecting bar will not have problems like tilt, bending or deformation. In addition, the present invention has a combined structure, so when any of components is damaged, it needs only to replace the damaged component(s) but not the whole shelf. Therefore, it is convenient to maintain and repair and low cost, and it is also easy to assemble, disassemble and cooperate with other structures.

Furthermore, the first connecting bar, the second connecting bar or/and the third connecting bar can be provided for hanging objects like towels or clothes. A plurality of the first connecting bars arranged in parallel or the cooperation of the first connecting bar and the second connecting bar can be provided for placing towels, clothes or other bathing products. The present invention is convenient, useful and multifunctional.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A bathroom shelf assembly, including:

a tubular member, having a tubular wall and an interior channel extending between two relative ends of the tubular member, the tubular wall provided with at least one first through hole;

at least one inserting member, disposed in the interior of the tubular member and having an axial through hole parallel to the interior channel;

a first rod member, disposed through the axial through hole in the interior channel;

at least one first connecting bar, at least one end of each first connecting bar formed with a first radial slot, each first connecting bar disposed through corresponding first through hole, the first radial slot spraddled onto the first rod member; and at least one second rod member, wherein the tubular wall of the tubular member is further formed with at least one second through hole whose opening direction opposite to an opening direction of the at least one first through hole, each inserting members further includes a lateral hole communicated with the axial through bore, the lateral hole corresponds to one of the second through hole, a first end of each second rod member extends through corresponding second through hole and into the interior channel, and the first rod member is disposed through the first end of the second rod member.

2. The bathroom shelf assembly of claim 1, wherein the inserting member has a positioning through hole, the second rod member has a positioning recession, and a positioning member is disposed through the positioning through hole and into the positioning recession.

3. The bathroom shelf assembly of claim 1, wherein a second end of the second rod member is further formed with a second connecting hole provided for a third connecting bar to connect thereto.

* * * * *